US009144710B1

(12) United States Patent
McNaughton

(10) Patent No.: US 9,144,710 B1
(45) Date of Patent: Sep. 29, 2015

(54) CLIMBING DEVICE

(76) Inventor: David James McNaughton, Chardon, OH (US)

( * ) Notice: Subject to any disclaimer, the term of this patent is extended or adjusted under 35 U.S.C. 154(b) by 175 days.

(21) Appl. No.: 13/588,328

(22) Filed: Aug. 17, 2012

Related U.S. Application Data

(60) Provisional application No. 61/674,065, filed on Jul. 20, 2012, provisional application No. 61/674,314, filed on Jul. 21, 2012.

(51) Int. Cl.
*A63B 27/00* (2006.01)

(52) U.S. Cl.
CPC ..... *A63B 27/00* (2013.01)

(58) Field of Classification Search
CPC ..... A01M 31/02; A63B 27/00
USPC ..... 182/92, 187; 248/219.4, 218.4
See application file for complete search history.

(56) References Cited

U.S. PATENT DOCUMENTS

| | | | | | |
|---|---|---|---|---|---|
| 2,499,753 | A * | 3/1950 | Hubbard | 24/68 CT |
| 4,109,761 | A * | 8/1978 | Matlock | 182/92 |
| 4,422,527 | A * | 12/1983 | Schultz et al. | 182/92 |
| 4,600,081 | A * | 7/1986 | Wade | 182/187 |
| 4,659,044 | A * | 4/1987 | Armstrong | 248/218.4 |
| 4,674,597 | A * | 6/1987 | Humphrey | 182/92 |
| 5,156,096 | A * | 10/1992 | Lamprey | 108/152 |
| 5,257,677 | A | 11/1993 | Stepp | |
| 5,279,388 | A * | 1/1994 | Laughlin et al. | 182/92 |
| 5,810,113 | A * | 9/1998 | Jones | 182/92 |
| RE36,276 | E | 8/1999 | Smith | |
| 6,431,315 | B1 * | 8/2002 | Lewis | 182/92 |
| 7,690,481 | B1 * | 4/2010 | Pederson | 182/133 |
| 7,753,170 | B1 * | 7/2010 | Gibson | 182/107 |
| 8,418,808 | B2 * | 4/2013 | Merritt | 182/92 |

OTHER PUBLICATIONS www.climbpaws.com, "Climb Paws, Hunt for the Best Buck, not the Best Tree!".

* cited by examiner

*Primary Examiner* — Katherine Mitchell
*Assistant Examiner* — Candace L Bradford
(74) *Attorney, Agent, or Firm* — Renner, Kenner, Greive, Bobak, Taylor & Weber

(57) ABSTRACT

A climbing device for a removable attachment to a column member, such as a tree, includes a body having a pair of spaced contact surfaces. The body also includes a pair of spaced and elongated retention apertures that are configured to receive a flexible retention member, such as a strap, therethrough. The retention member initially retains the climbing device to the column member, such that the contact surfaces are urged against the column member. In addition, the retention members are spaced apart such that their top portions are spaced further apart than their bottom portions. Thus, as the climbing body is forced downward along the column member, the distance between the spaced retention apertures increases, causing the circumferential distance traversed by the retention member to increase, thus drawing the retention member taut.

20 Claims, 13 Drawing Sheets

CLIMBING DEVICE

CROSS-REFERENCE TO RELATED APPLICATIONS

This application claims the benefit of U.S. Provisional Application No. 61/674,065 filed on Jul. 20, 2012, and U.S. Provisional Application No. 61/674,314 filed on Jul. 21, 2012, the contents of which are incorporated herein by reference.

FIELD OF THE INVENTION

The present invention relates to devices used to climb a column member, such as a tree. Particularly, the present invention relates to a portable climbing device that is configured to be removably attached to a column member. More particularly, the present invention relates to a climbing device that is secured to a column member by a flexible retention member.

BACKGROUND OF THE INVENTION

Various individuals such as hunters, researchers, photographers, and arborists often need to ascend column members, such as trees or poles for example. To achieve this, such individuals are required to carry all of their climbing equipment with them to the climbing site on foot, sometimes for considerable distances. Unfortunately, current climbing devices are heavy and/or awkward to carry, and in many circumstances are cumbersome to use.

In addition, an increasing number of States have passed regulations prohibiting the use of any climbing device that damages trees on public hunting land. However, many climbing devices impart damage to trees when they are used and as such, are prohibited from use on such public land. In addition, homeowners who employ the services of arborists would also benefit from a climbing device that does not damage the trees they need to maintain.

Furthermore, individuals such as hunters, photographers, and naturalists are required to maintain a quiet or stealth presence as they enter the field to prevent startling or otherwise alerting wildlife of their presence. However, many currently available climbing devices generally make noise as they are used and attached to trees or other column member, due to their complex mechanical construction and material used.

Therefore, there is a need for a climbing device that is strong, lightweight, and portable. In addition, there is a need for a climbing device that does not impart damage or trauma to a tree or other column member when attached thereto. Furthermore, there is a need for a climbing device that is quiet and allows a user to maintain a stealth presence when transported and when in use as it is attached to a tree or other column member.

SUMMARY OF THE INVENTION

In light of the foregoing, it is a first aspect of the present invention to provide a climbing device for climbing a column member comprising a body having a top step and a bottom rim; first and second contact surfaces extending at least partially between said first step and second said bottom rim; a concave section disposed between at least said first and second contact surfaces, wherein the width of said concave section decreases as said concave section extends from said top step to said bottom rim; and first and second retention apertures elongated so as to have a top and bottom disposed through said body and spaced apart by the width of said concave section, wherein said first retention aperture is proximate to said first contact surface and said second aperture is proximate to said second contact surface, such that said first and second retention apertures are respectively spaced from said first and second contact surfaces, whereby said first and second retention apertures are configured to receive a flexible retention member therethrough to attach said body to the column member, and wherein said flexible retention member is slideably received from said bottom of said first and second retention apertures to said top of said first and second retention apertures when in use.

It is another aspect of the present invention to provide a method for using a climbing device comprising providing a climbing device comprising a body that includes a top step and a bottom rim; first and second contact surfaces extending at least partially between said first step and said bottom rim; a concave section disposed between at least said first and second contact surfaces, wherein the width of said concave section decreases as said concave section extends from said top step to said bottom rim; and first and second retention apertures elongated so as to have a top and bottom disposed through said body and spaced apart by the width of said concave section, wherein said first retention aperture is proximate to said first contact surface and said second retention aperture is proximate to said second contact surface, such that said first and second retention apertures are respectively spaced from said first and second contact surfaces; attaching said body to a column member by placing a flexible retention member through said first and second retention apertures, said first and second contact surfaces are at least partially in contact with the column member; and forcing said body downward, such that the flexible retention member is slideably received from said bottom of said first and second retention apertures to said top of said first and second retention apertures when in use.

BRIEF DESCRIPTION OF THE DRAWINGS

The detailed embodiments of the present invention will be better understood by referencing the following descriptions and their accompanying drawings, wherein.

WRITTEN DESCRIPTION

Figure 1:
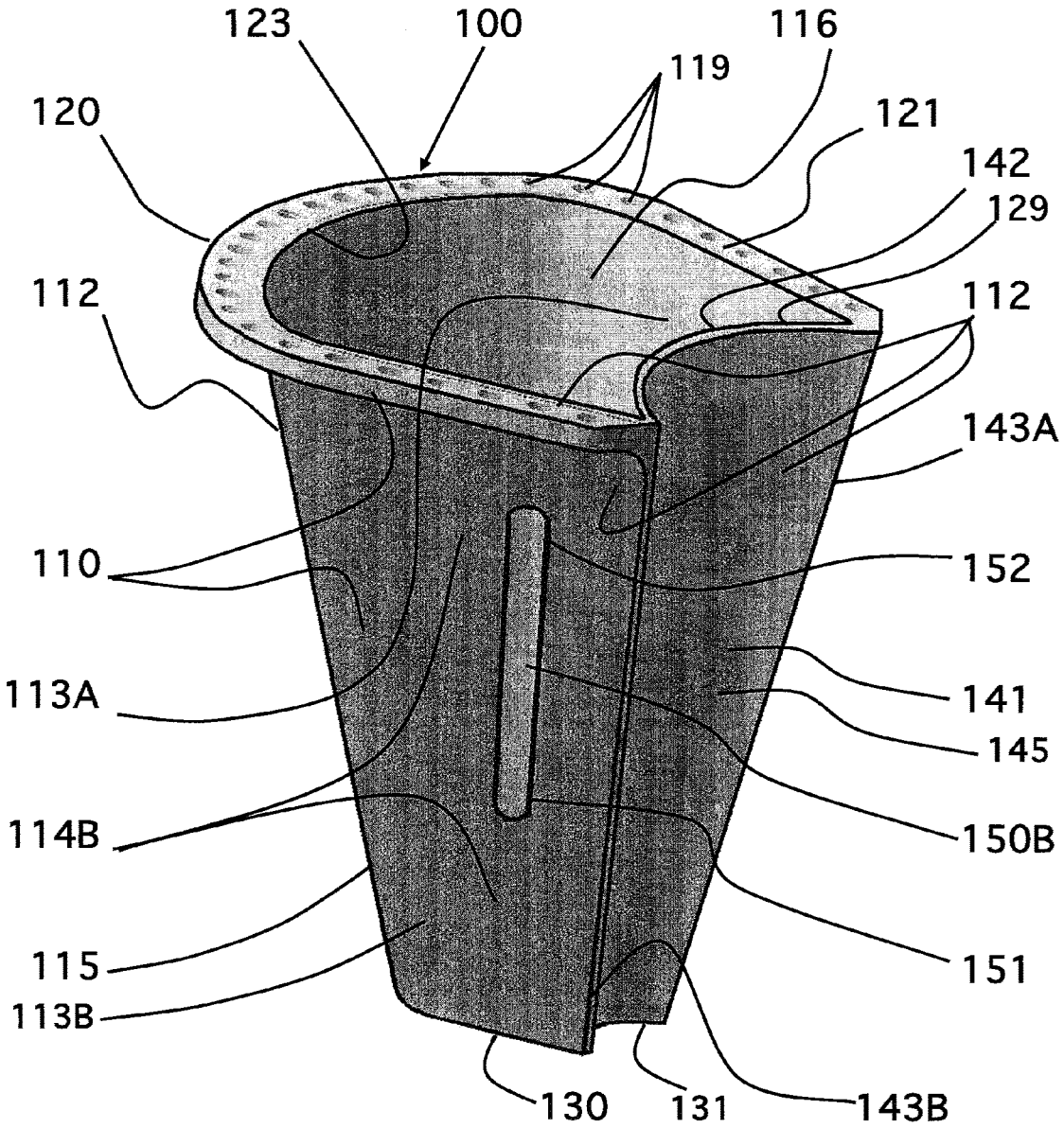
FIG. 1 is an isometric view of the climbing device constructed in accordance with one exemplary embodiment of the present invention, shown top end up and from the rear corner perspective in accordance with the concepts of the present invention.
Figure 2:
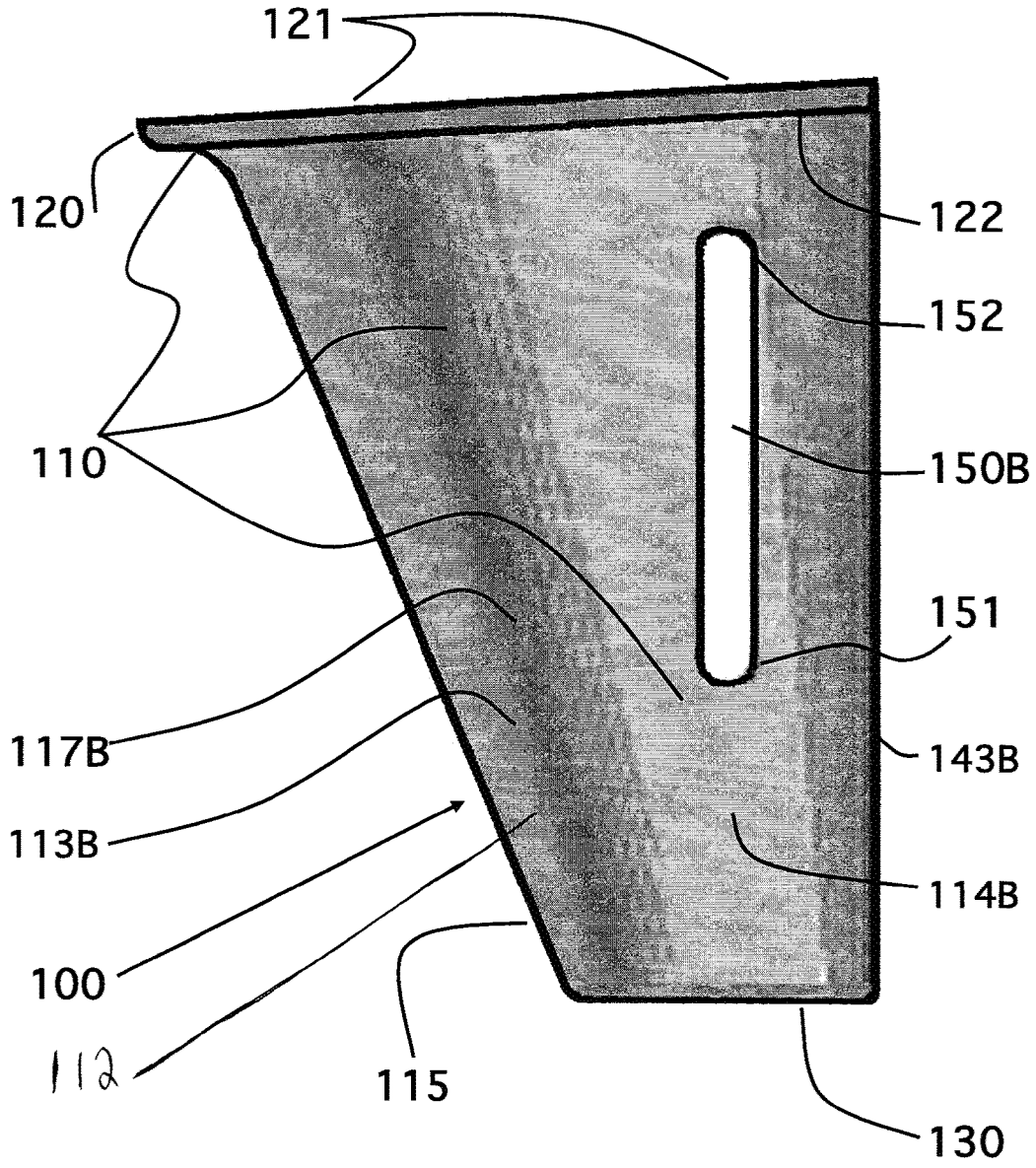
FIG. 2 is a side view of the climbing device of FIG. 1 in accordance with the concepts of the present invention.
Figure 3:
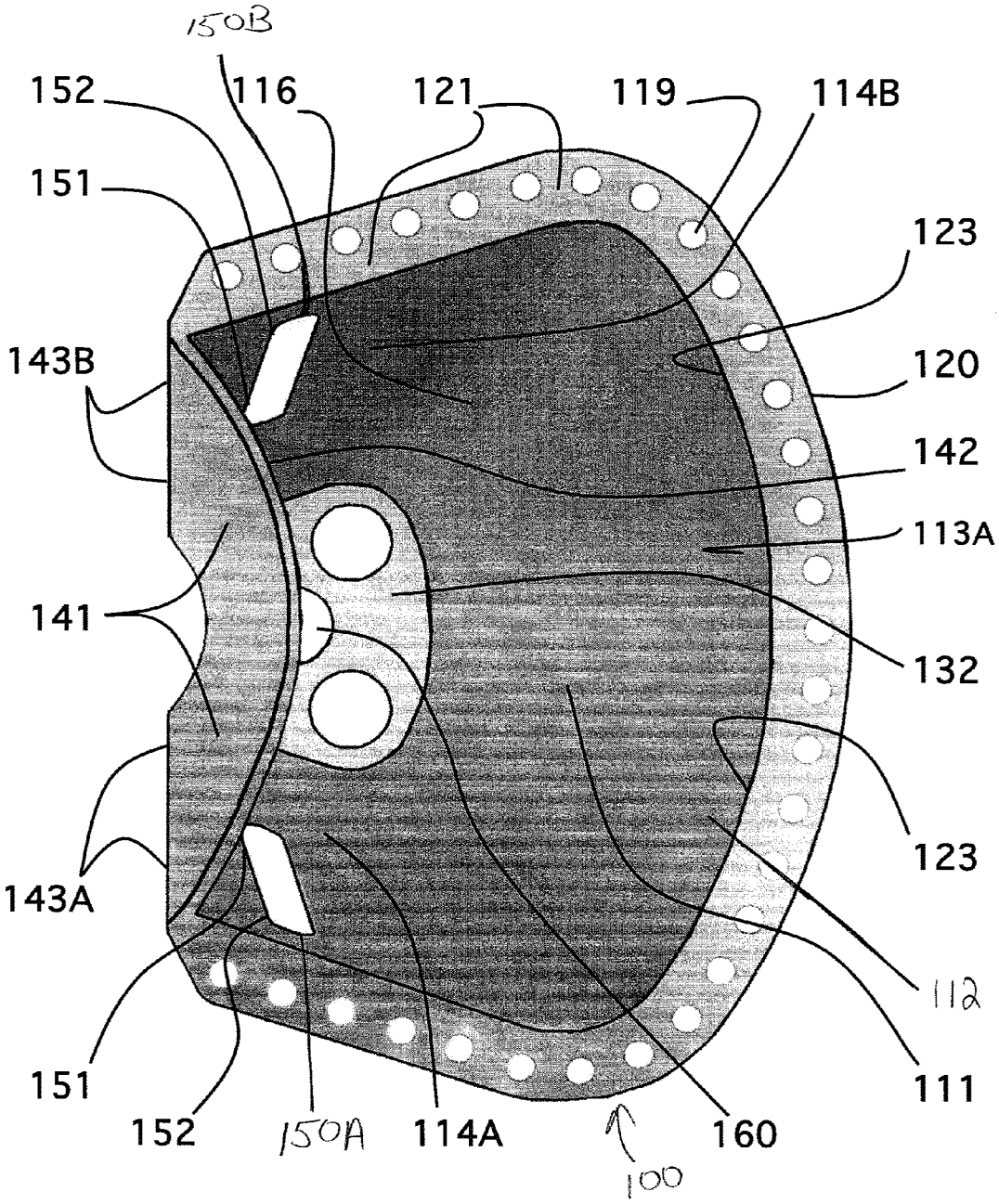
FIG. 3 is an overhead view of the climbing device of FIG. 1 in accordance with the concepts of the present invention.
Figure 4:
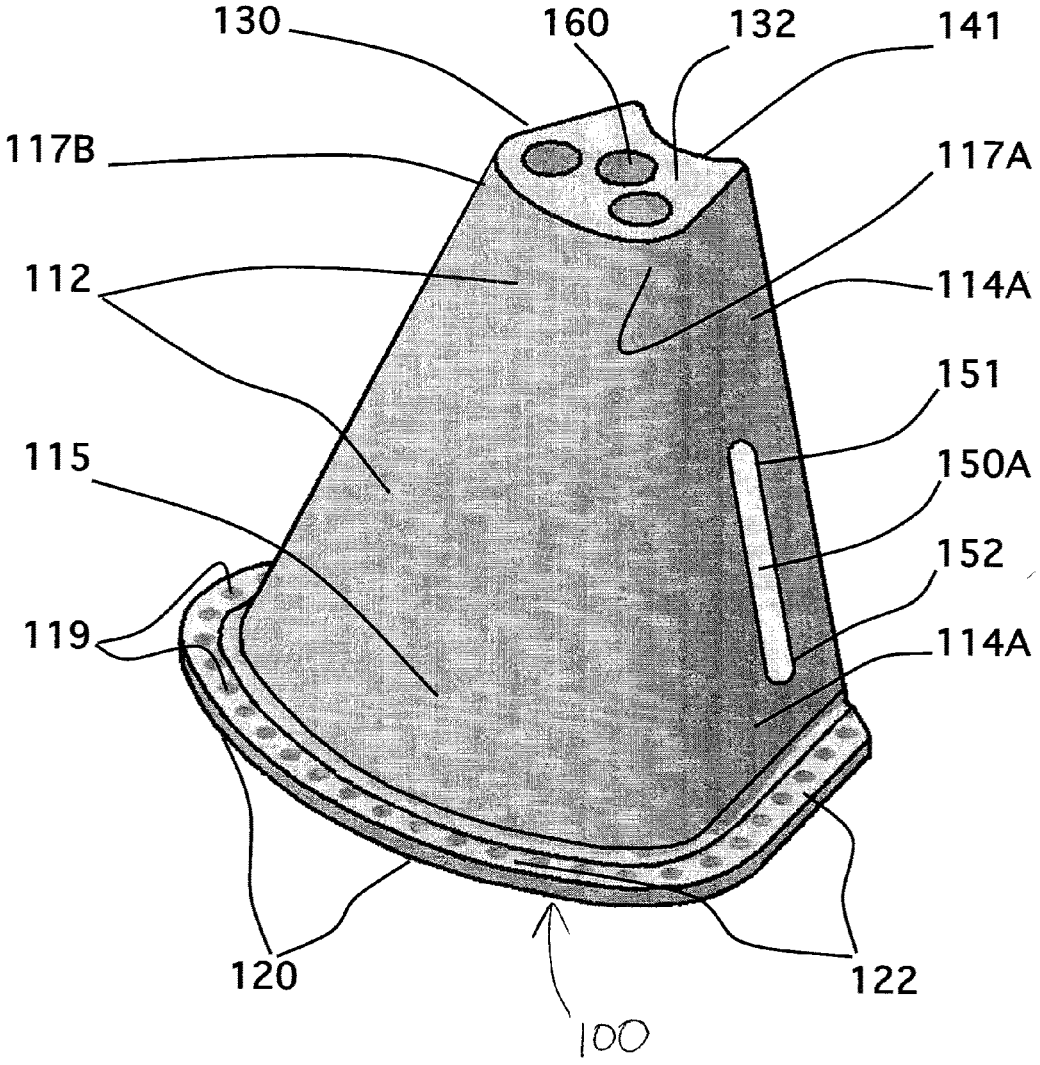
FIG. 4 is an isometric view of the climbing device of FIG. 1, shown upside down and from the front corner perspective in accordance with the concepts of the present invention.

A climbing device for attachment to a column member 140 is generally referred to by numeral 100, as shown in FIGS. 1-12 of the drawings. It should be appreciated that the column member 140 may comprise any at least partially vertically extending and substantially cylindrical member, such as a tree, pole, or post for example. Specifically, the climbing device 100 comprises a body 110 that includes an outer body section 112 that is terminated by a top step 121 and a lower rim or edge 130 and by first and second contact surfaces 143A and 143B. It should be appreciated that the contact surfaces 143A,143B may be smooth or texturized to enhance their gripping capabilities. Furthermore, the outer body section 112 has opposed inner and outer surfaces 113A and 113B. Extending between the contact surfaces 143A,143B of the outer body section 112 is a concave inner body section 141 having a concave surface 145 that is distal to or that faces away from the inner surface 113 of the outer section 112 and an opposed convex surface 142 that is proximate to or that faces the inner surface 113 of the outer body section 112. The concave inner body section 141 is terminated by opposed upper and lower ends 129 and 131 and are in respective alignment with the top step 121 and lower rim 130. In addition, the concave inner body section 141 is configured such that the width of the upper end 129 is wider than the width of the lower end 131 while the concave surface 141 maintains the same radius of curvature throughout its length. That is, the concave inner body section 111 is tapered, such that its width decreases from its upper end 129 to its lower end 131. Together, the inner and outer body sections 141 and 112 define a hollow cavity 116 within the body 110. However, it should be appreciated that the body 110 may be formed so as to be solid. It should be appreciated that the body 110 may be formed from any suitable material, including but not limited to plastic or metal for example.

The outer body section 112 includes a first curved section 115 that terminates at first and second radiused corners 117A and 117B. Extending between the first and second radiused corners 117A and 117B of the respective first and second contact surfaces 143A and 143B are respective substantially planar support sections 114A and 114B. In one aspect, while the support sections 114A,114B may be substantially trapezoidal in shape, they may be any suitable shape. The planar support sections 114A,114B are canted or angled along its longitudinal axis, such that the upper ends 129 of the support sections 114A,114B are spaced apart further than the lower ends 130 of the support sections 114A,114B are spaced apart. In addition, the support sections 114A and 114B also extend away from the center or midline of the body 110 from respective the contact surfaces 143A,143B. Thus, the planar support sections 114A and 114B are angled along two axes.

Disposed through each of the support sections 114A,114B are respective elongated retention apertures 150A and 150B, each having opposed upper and lower ends 152 and 151. The retention apertures 150A,150B are substantially horizontally and vertically aligned with each other and are spaced from the respective contact surfaces 143A and 143B. The retention apertures 150A-B are configured to receive a flexible retention member 170 therethrough, which may include but is not limited to a strap, rope, or cable, for example. Furthermore, the retention apertures 150A,150B are dimensioned so that a sufficient distance exists between their upper and lower ends 152,151 to allow the climbing device 100 to slide or move upon the retention member 170 via the retainer apertures 150A,150B a distance when the retention member 170 is received through the retention apertures 150A,150B and through the cavity 116 of the climbing device 100 and secured to the column member 140, as discussed in detail below.

The top step 121 of the outer body section 112 may comprise any suitable edge or section. Furthermore, the top step 121 may comprise a support flange 120 that is configured to enhance the traction or grip that the user's foot or shoe achieves when placed thereon. Disposed through the support flange 120 is a plurality of apertures 119 to facilitate the enhanced traction or grip that the user's foot or shoe achieves when placed thereon. However, any other suitable traction-improving shapes, such as grooves, slots, or serrations for example, may be used.

Figure 5:
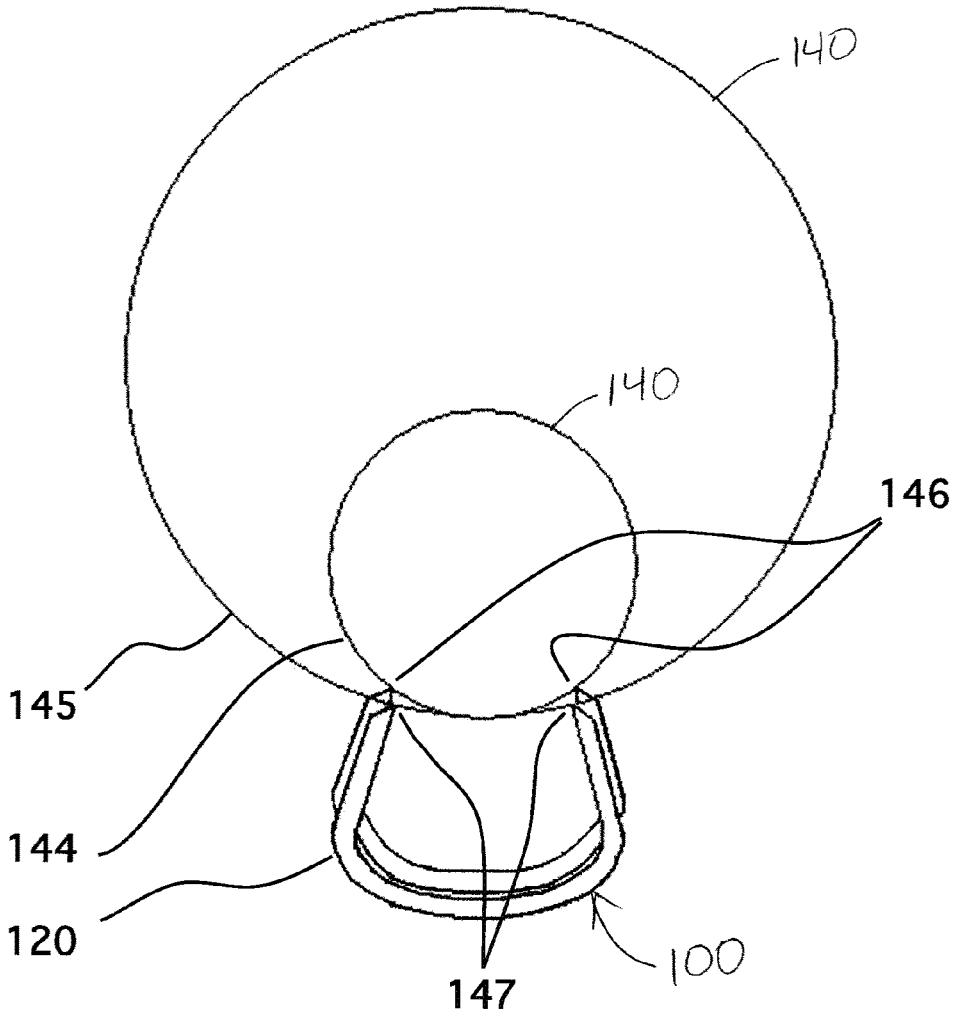
FIG. 5 is an overhead view of the climbing device of FIGS. 1 and 3, as applied to two different diameter columns in accordance with the concepts of the present invention.

When applying the climbing device 100 to the column member 140 of smaller 144 or larger 145 diameters as shown in FIG. 5, the tangent points of the smaller 146 or the larger 147 diameter column members 140 are different and thereby alter the angle of the support flange 120, moving the outer rim of the support flange 120 upward as the column member 140 diameters decrease. To compensate for the difference in the respective diameters 144 and 145 that a column member 140 may have, the climbing device 100, support flange 120, and top step 121 are angled downward as the support flange 120 projects away from the column member 140. This provides the user a concave inner tread edge 123 to a relatively perpendicular surface, depending on the column member 140 diameter, thereby enhancing traction and safety.

Attached to the lower ends 130,131 of the body 110 of the climbing device 100 is a base section 132 that includes a plurality of apertures 160 disposed therethrough so as to allow liquid, such as water, and other debris to pass through the climbing device without accumulating in the cavity 116.

Thus, when the climbing device 100 is attached to the column member 140, such as a tree for example, the contact surfaces 143A,143B are placed in contact against the outer surface of the column member 140, such that the support flange 120 is proximate to the top of the column member 140. Placing the climbing device 100 in such an orientation results in the widest portion of the concave inner body section 141 being positioned above the narrowest portion of the concave inner body section 141 when the climbing device 100 is placed in contact with the column member surface 140 prior to being secured thereto.

Figure 8:
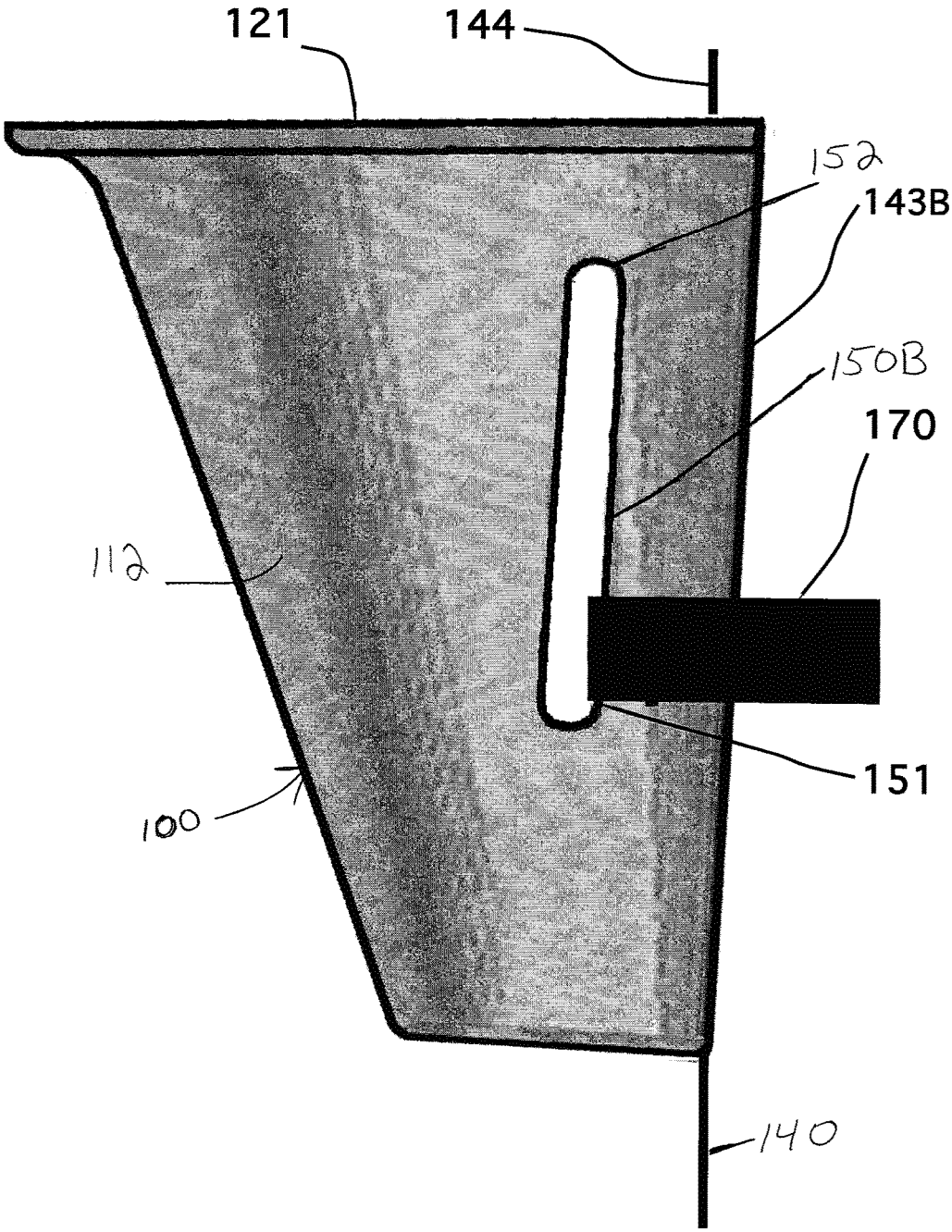
FIG. 8 is a side view of the climbing device of FIGS. 1 and 2, with the tensioning strap in the lower, or attached, position as applied to a smaller diameter column in accordance with the concepts of the present invention.
Figure 9:
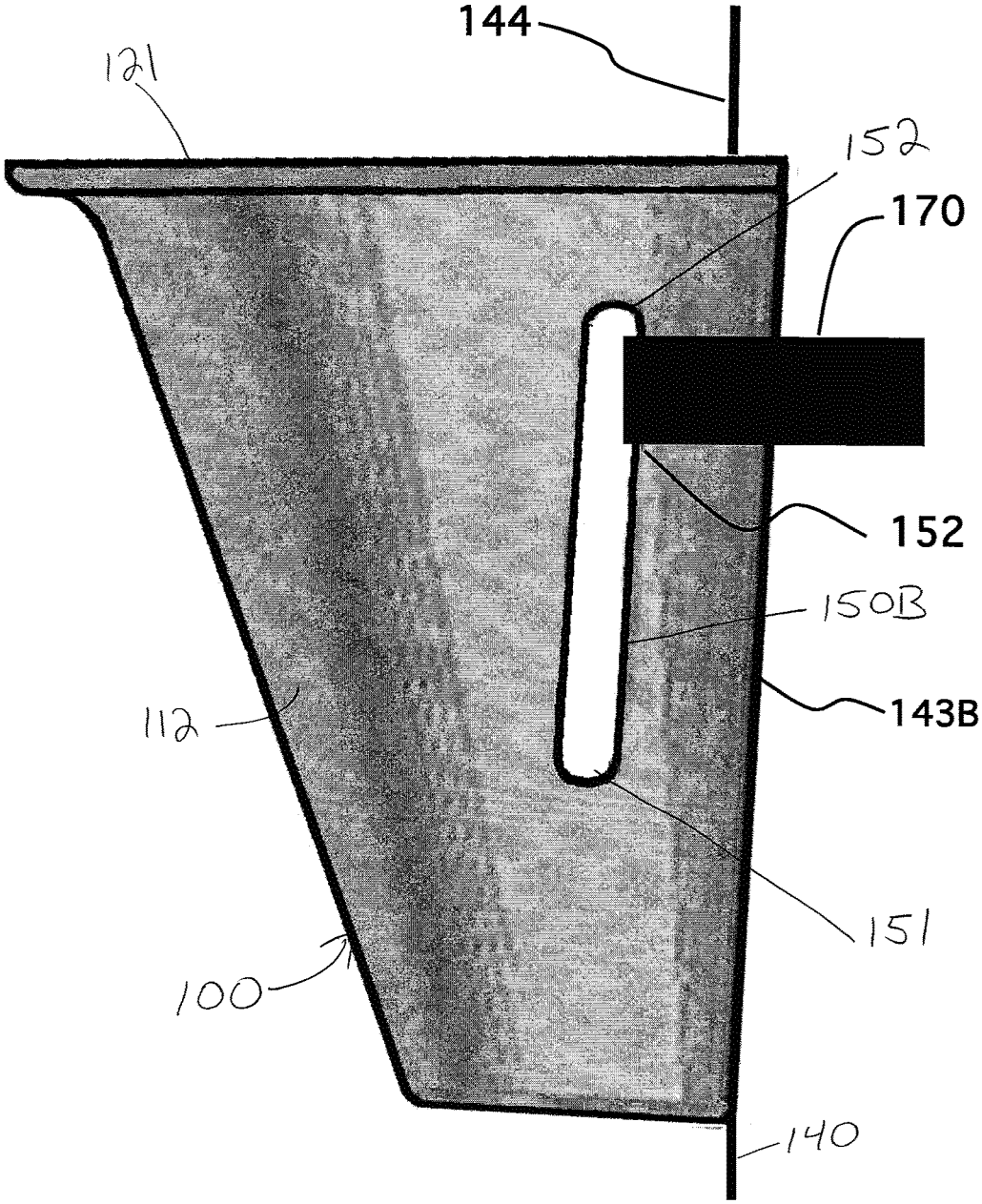
FIG. 9 is a side view of the climbing device of FIGS. 1 and 2, with the tensioning strap in the higher, or secured, position as applied to a smaller diameter column in accordance with the concepts of the present invention.
Figure 10:
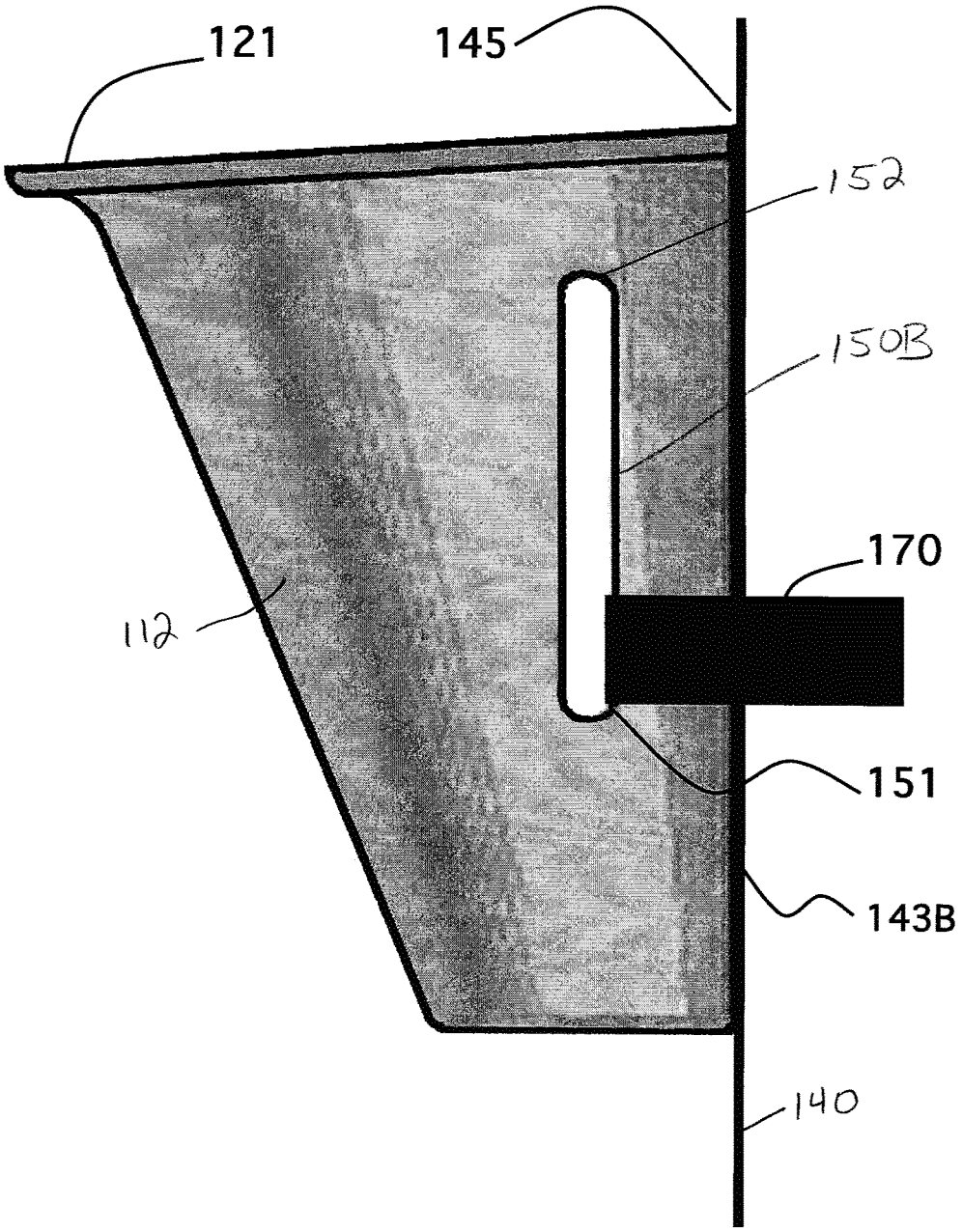
FIG. 10 is a side view of the climbing device of FIGS. 1 and 2, with the tensioning strap in the lower, or attached, position as applied to a larger diameter column in accordance with the concepts of the present invention.
Figure 13:
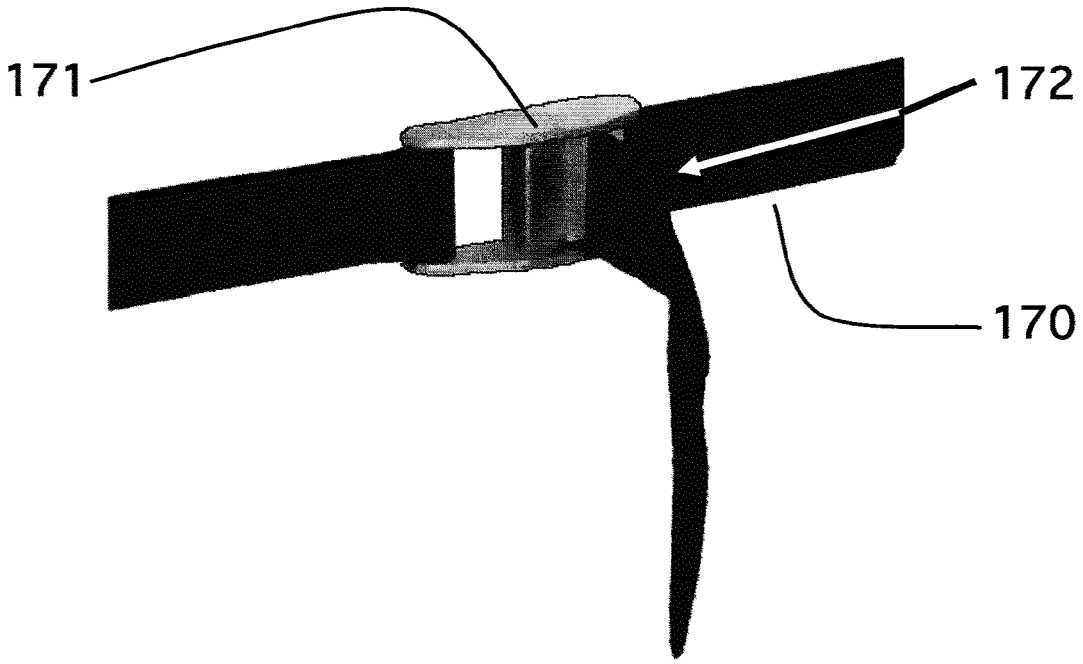
FIG. 13 is a perspective view of a cam buckle device used as a flexible retention member to removably retain the climbing device to a column member in accordance with the concepts of the present invention.

With the discussion of the structural components of the climbing device 100 set forth, the following discussion presents the manner for using the climbing device 100 with a column member 140 that comprises a tree, as shown in FIGS. 8-11. Specifically, FIGS. 8-9 relate to the use of the climbing device 100 on smaller 144 diameter column members 140, and FIGS. 10-11 relate to the use of the climbing device 100 on larger 145 diameter column members 140. To place the climbing device into use, the climbing device 100 is secured to the column member 140 by the flexible retention member 170 that is received through each of the retention apertures 150 and placed about the periphery of the column member outer surface 140. The ends of the flexible retention member 170 may be fastened together to secure the climbing device 100 to the column member 140 by tying a knot, or by using any other suitable means of fastening, such as a cam buckle device 171, and the like. Specifically, a cam buckle device 171, as shown in FIG. 13, comprises a tensioning devise that uses a flexible retention member 170 and a clamping mechanism 171 that are engaged by placing the retention member 170 through the clamping mechanism 171. Furthermore, the retention member 170 is prevented from moving in a direction that is opposite to the direction of the retention member's installation direction 172. Specifically, the retention member 170 is initially positioned within the elongated retention apertures 150 such that the lower end 151 of each of the retention apertures 150 is proximate or adjacent to the retention member 170 when the climbing device 100 is attached to the column member 140, as shown in FIGS. 8 and 10. This initial position results in the contact surfaces 143A,143B that are spaced apart by the narrower portion of the concave inner body section 141 being urged against the outer surface of the column member 140 by the retention member 170.

Figure 6:
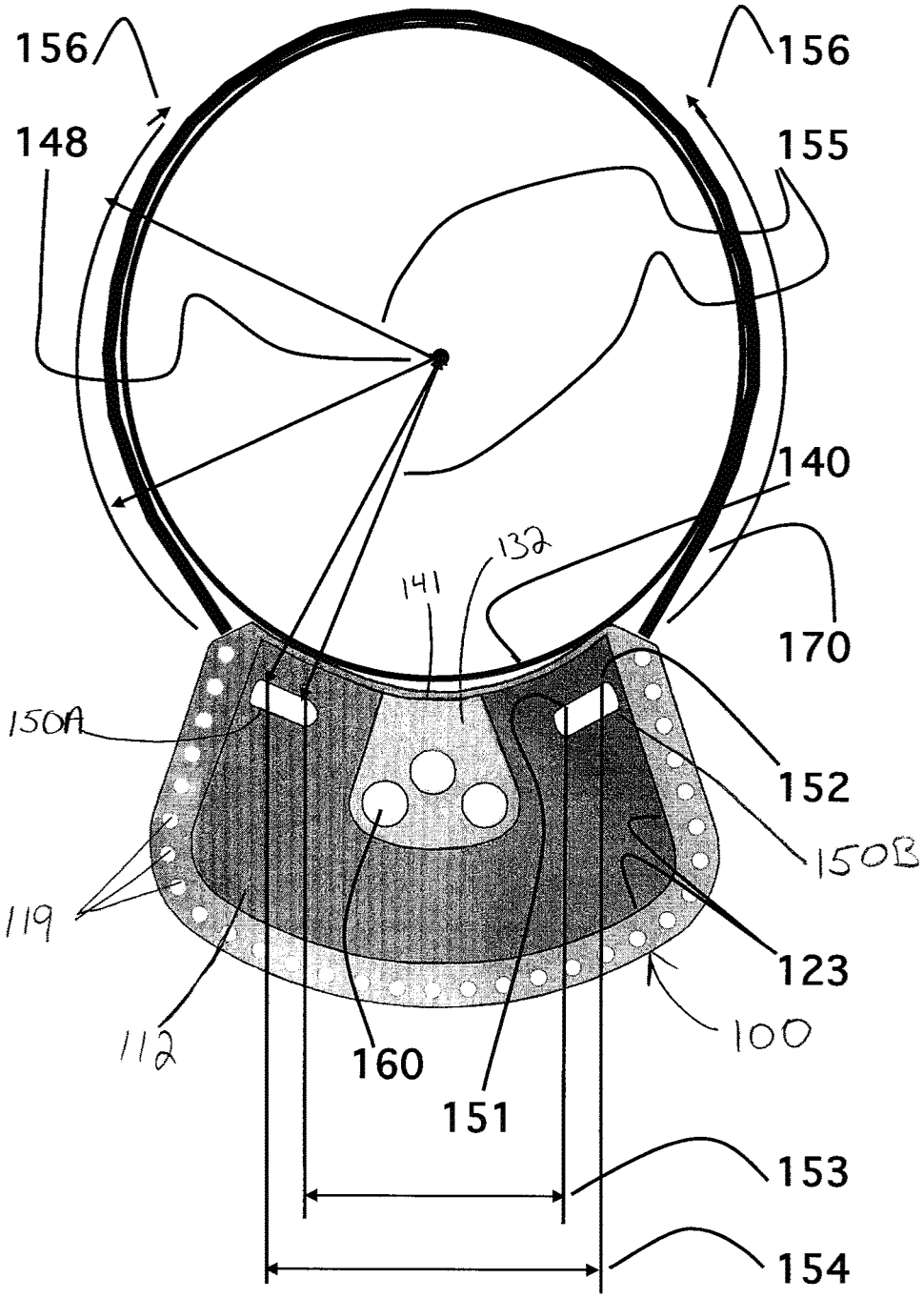
FIG. 6 is an overhead view of the climbing device of FIGS. 1 and 3, with the tensioning strap partially removed to show attributes of the climbing device's function in accordance with the concepts of the present invention.
Figure 7:
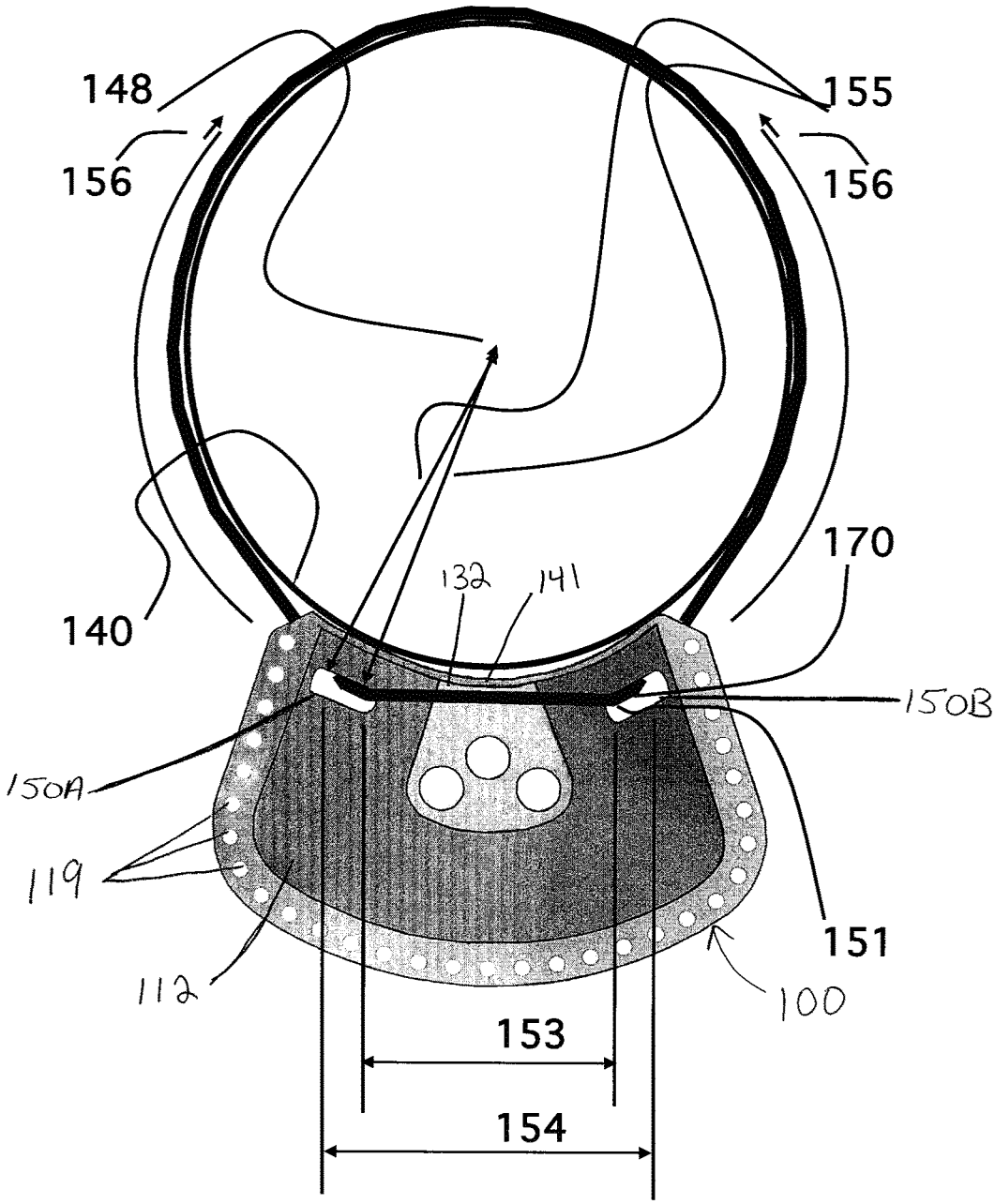
FIG. 7 is an overhead view of the climbing device of FIGS. 1 and 3, with the tensioning strap installed in the attached position in accordance with the concepts of the present invention.
Figure 11:
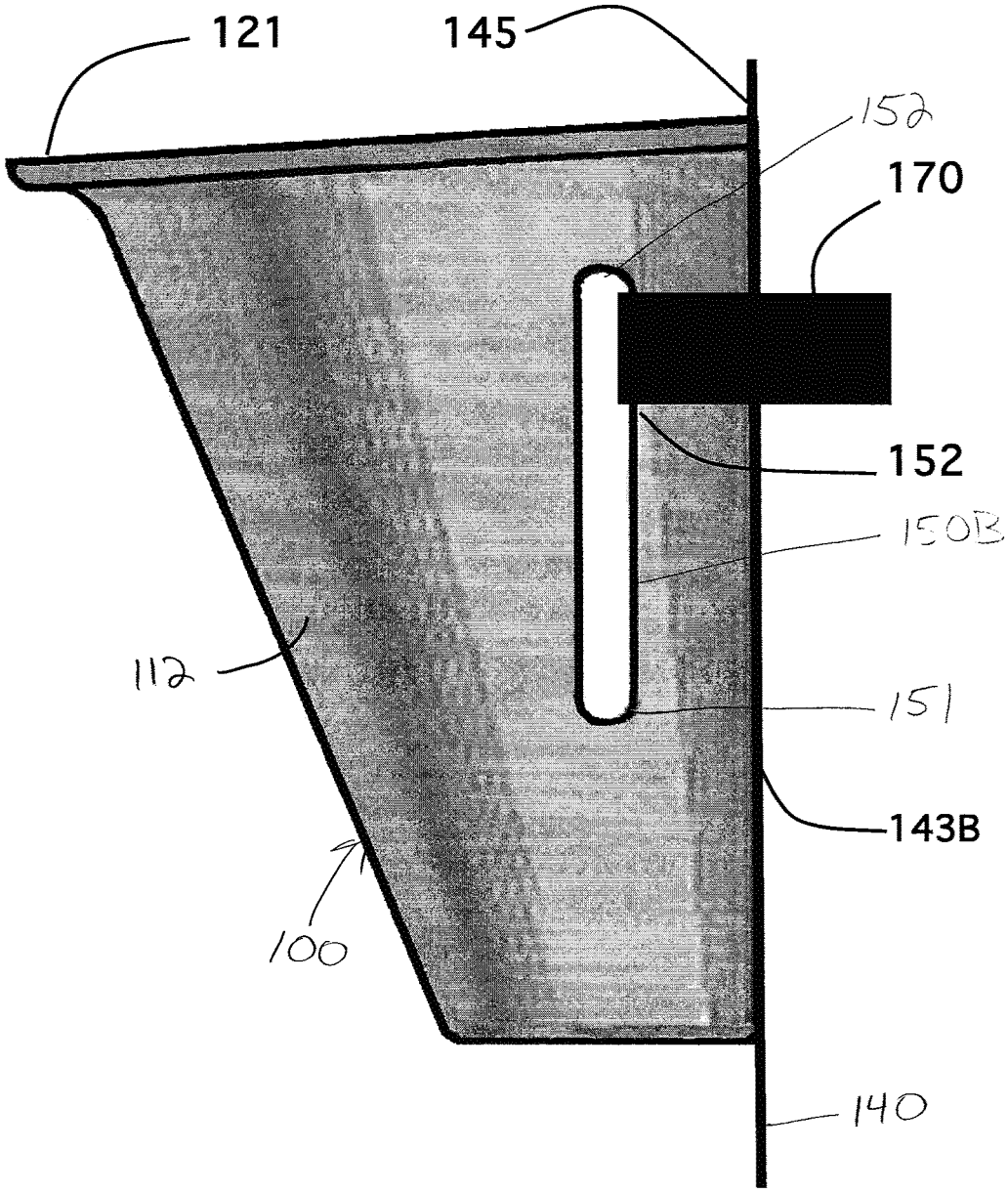
FIG. 11 is a side view of the climbing device of FIGS. 1 and 2, with the tensioning strap in the higher, or secured, position as applied to a larger diameter column in accordance with the concepts of the present invention.

Next, with the retention member 170 remaining secured to the column member 140, the climbing device 100 is moved downward, as shown in FIGS. 9 and 11, along the column member 140 such that the body 110 is moved so that the top 152 of each of the retention apertures 150A,150B is proximate or adjacent to the retention member 170. This results in the contact surfaces 143A,143B that are spaced apart by the wider portion of the concave inner body section 141 being urged against the outer surface of the column member 140 by the tension applied by the retention member 170. Furthermore, because the bottom 151 of each of the retention apertures 150A-B are closer together than the top 152 of the retention apertures 150A-B, any remaining slack in the retention member 170 that was present during the initial positioning or attachment of the retention member being proximate or adjacent to the bottom of the retention apertures 151 is taken up, causing the retention member 170 to be drawn taut as the retention apertures 150A-B are moved downward relative to the retention member 170 by moving the climbing device 100 downward relative to the stationary retention member 170. Additionally, the retention apertures 150A,150B and contact surfaces 143A,143B are parallel to each other and thereby maintain a constant radial distance from the column centerline 148. This causes the points at which the retention member 170 contacts the retention apertures 150 to move in a circumferential direction 156 away from each other 153,154 as the climbing device 100 is moved downward along the column member 140, resulting in the retention member 170 being drawn taut circumferentially 156, as shown in FIGS. 6 and 7, maintaining radial distance 155. That is, as the climbing device 100 is moved downward by applying force thereto, a greater length of the retention member 170 passes between the retention apertures 150A-B as the tops 152 of the retention apertures 150A-B are spaced further apart than the bottoms 151 of the retention apertures 150A-B. Once the climbing device 100 is moved downward, it is then fully secured to the column member 140 and can be stepped upon by a user's foot or grasped by a user's hand to carry the weight of an individual. Moreover, the process described above is repeated with multiple climbing devices 100, as the user traverses upward along the column member 140.

Figure 12:
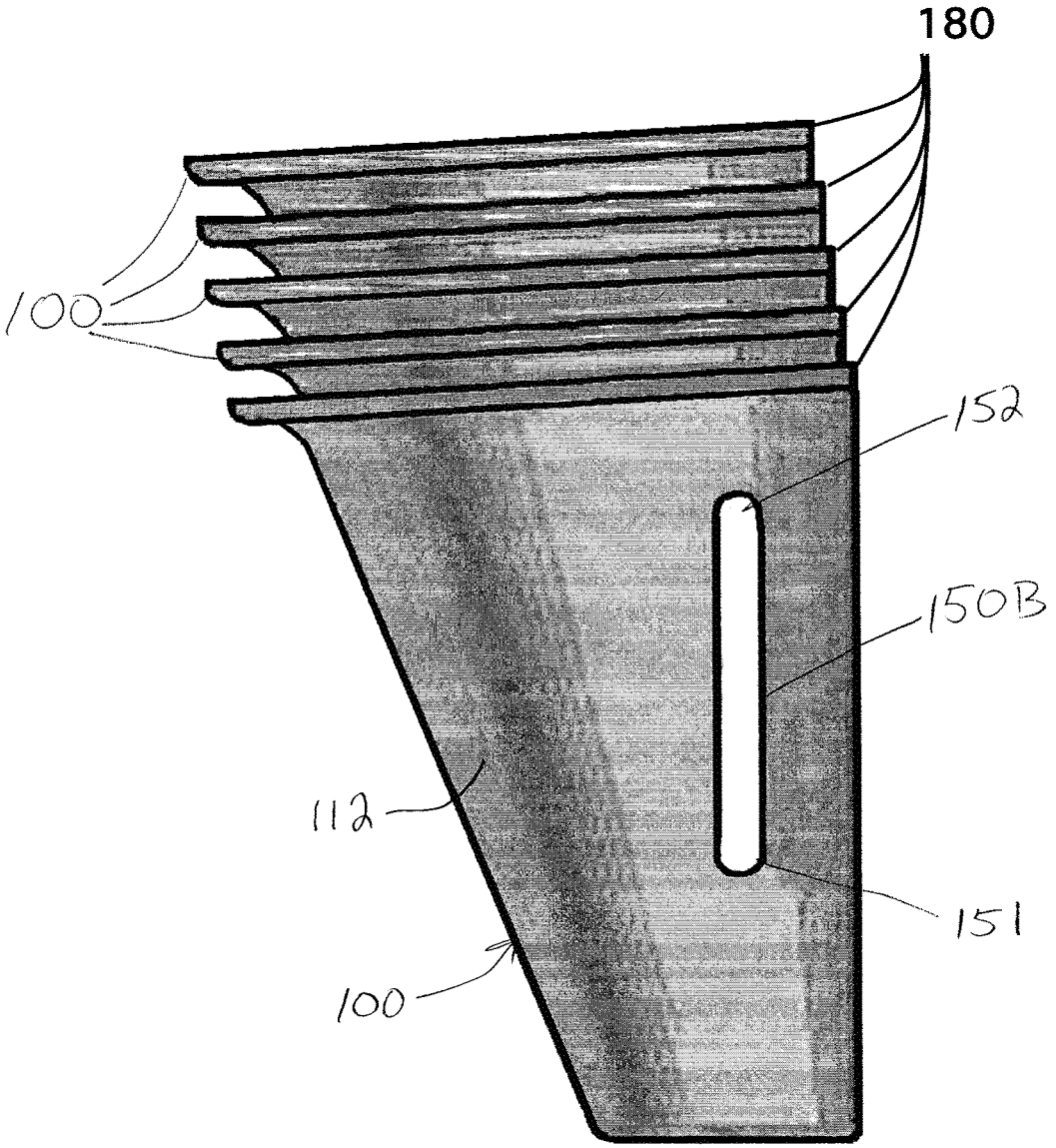
FIG. 12 is a side view of the climbing device of FIGS. 1 and 2, stacked one inside the other for transportation and storage in accordance with the concepts of the present invention.

To facilitate easy transport, the climbing device 100 may be stacked one inside the other 200, as shown in FIG. 12.

Therefore, one advantage of the present invention is that a climbing device for climbing a column member is strong, lightweight, and quiet when in use and in transport. Some other advantages of the present invention due to its shape are a climbing device for climbing a column member that includes tread surface angle of a support flange to compensate for different diameter columns. Still another advantage of the present invention is that a climbing device for climbing a column member includes spaced and tapered contact surfaces to contact the outer surface of the column member.

It will be understood that the embodiments described herein are merely exemplary and that a person skilled in the art may make many modifications and variations without departing from the spirit and scope of the invention. All such variations and modifications are intended to be included within the scope of the invention as defined in the appended claims.

What is claimed is:

1. A climbing device that includes a flexible retention member for climbing a column member, the climbing device further comprising:

a body having a top step and a bottom edge, said body having a longitudinal axis;

a first contact surface and a second contact surface, spaced apart, and extending at least partially between said top step and said bottom edge, wherein said first and second contact surfaces are substantially smooth;

a first support section extending from at least one of said top step or said bottom edge, said first support section proximate to said first contact surface;

a second support section extending from at least one of said top step or said bottom edge, said second support section proximate to said second contact surface; and a first elongated retention aperture disposed through said first support section and spaced from said first contact surface, and a second elongated retention aperture disposed through said second support section and spaced from said second contact surface, said first and second retention apertures each having a top end and a bottom end, whereby said first and second retention apertures are configured to receive the flexible retention member therethrough to attach said body to the column member, said retention member remaining fixed in position relative to the column member, whereby said top and bottom ends of said first retention aperture are spaced apart from each other, and said top and bottom ends of said second retention aperture are spaced apart from each other, whereby said first and second retention apertures are slideable relative to the retention member, such that only said top ends of said first and second retention apertures or said bottom ends of said first and second retention apertures are positionable proximate to the retention member at any one time;

wherein said first support section and said second support section extend away from the longitudinal axis of said body from said bottom edge to said top step, such that said first support section and said second support section diverge from each other, said top ends of said first and second retention apertures being spaced apart from each other further than said bottom ends of said first and second retention apertures are spaced apart from each other, whereby when the retention member is positioned proximate to at said bottom end of said first and second retention apertures a first length amount of the retention member passes between said first and second retention apertures, and when the retention member is positioned proximate to said top end of said first and second retention apertures a second length amount of the retention member passes between said first and second retention apertures, such that the second length amount is greater than the first length amount;

wherein, when said body is attached to the column member, the first length amount of the retention member is held away from the column member proximate to said bottom end of said first and second retention apertures, such that when said top step is stepped upon, said body is slideably moved downward relative to the column member, so as to move said first and second retention apertures relative to said fixed retention member, such that the second length amount of the retention member is held away from the column member proximate to said top end of said first and second retention apertures, so as to tighten the retention member and to secure said first and second contact surfaces against the column member.

2. The climbing device of claim 1, wherein said top step comprises a solid surface.

3. The climbing device of claim 1, wherein said top step comprises a flange extending from said body.

4. The climbing device of claim 3, wherein said flange includes a plurality of apertures disposed therethrough.

5. The climbing device of claim 1, wherein said body includes a base section attached to said bottom edge.

6. The climbing device of claim 5, wherein said base section includes a plurality of apertures disposed therethrough.

7. The climbing device of claim 1, wherein at least a portion of said body is conical in shape.

8. The climbing device of claim 1, wherein said first and second retention apertures are substantially equidistant from a longitudinal centerline of the column member.

9. The climbing device of claim 1, wherein said first and second retention apertures are substantially parallel to respective said first and second contact surfaces.

10. The climbing device of claim 1, wherein said first and second contact surfaces extend from said top step to said bottom rim.

11. The climbing device of claim 1, further comprising:

a concave section disposed between said first and second contact surfaces; and an outer wall extending from at least one of said top step or said bottom edge;

wherein said concave section is spaced from said outer wall so as to define a cavity.

12. A method for using a climbing device comprises:

providing a climbing device that includes a flexible retention member, the climbing device further comprising:

a body having a top step and a bottom edge, said body having a longitudinal axis;

a first contact surface and a second contact surface, spaced apart, and extending at least partially between said top step and said bottom edge, wherein said first and second contact surfaces are substantially smooth;

a first support section extending from at least one of said top step or said bottom edge, said first support section proximate to said first contact surface;

a second support section extending from at least one of said top step or said bottom edge, said second support section proximate to said second contact surface;

a first elongated retention aperture disposed through said first support section and spaced from said first contact surface and a second elongated retention aperture disposed through said second support section and spaced from said second contact surface, said first and second retention apertures each having a top end and a bottom end, wherein said first support section and said second support section extend away from the longitudinal axis of said body from said bottom edge to said top step, such that said first support and said second support section diverge from each other, said top ends of said first and second apertures being spaced apart from each other further than said bottom ends of said first and second retention apertures;

wherein said first and second retention apertures are configured to receive the flexible retention member therethrough, such that said retention member remains in a fixed position relative to the column member, whereby said top and said bottom ends of said first retention aperture are spaced apart from each other, and said top and bottom ends of said second retention aperture are spaced apart from each other, whereby said first and second retention apertures are slideable relative to the retention member, such that only said top ends of said first and second retention apertures or said bottom ends of said first and second retention apertures are positionable proximate to the retention member at any one time, such that when the retention member is positioned proximate to said bottom end of said first and second retention apertures a first length amount of the retention member passes between said first and second retention apertures, and when the retention member is positioned proximate to said top end of said first and second retention apertures a second length amount of the retention member passes between said first and second retention apertures, such that the second length amount is greater than the first length amount;

attaching said body to a column member by placing the flexible retention member through said first and second retention apertures, such that said first and second contact surfaces are at least partially in contact with the column member and such that the first length amount of the retention member is held away from the column member at said bottom end of said first and second retention apertures; and forcing said body downward relative to the column member, so as to move said first and second retention apertures relative to said fixed retention member, such that the second length amount of the retention member is held away from the column member proximate to said top end of said first and second retention apertures, so as to tighten the retention member and to secure said first and second contact surfaces against the column member.

13. The climbing device of claim 12, wherein said top step comprises a flange extending from said body.

14. The climbing device of claim 12, wherein said body includes a base section attached to said bottom edge.

15. The climbing device of claim 14, wherein said base section includes a plurality of apertures disposed therethrough.

16. The climbing device of claim 12, wherein at least a portion of said body is conical in shape.

17. The climbing device of claim 12, wherein said first and second retention apertures are substantially equidistant from a longitudinal centerline of the column member.

18. The climbing device of claim 12, wherein said first and second retention apertures are substantially parallel to respective said first and second contact surfaces.

19. The climbing device of claim 12, wherein said first and second contact surfaces extend from said top step to said bottom rim.

20. The climbing device of claim 12, further comprising:

a concave section disposed between said first and second contact surfaces.

* * * * *